US005718250A

United States Patent [19]

Banerjee et al.

[11] Patent Number: 5,718,250

[45] Date of Patent: Feb. 17, 1998

[54] LOW GAS PHASE FILTER FOR CIGARETTES

[75] Inventors: Chandra Kumar Banerjee, Pfafftown; Karen Marie Womble, Winston-Salem; Joanne Naomi Taylor, Germanton, all of N.C.

[73] Assignee: R. J. Reynolds Tobacco Company, Winston-Salem, N.C.

[21] Appl. No.: 320,074

[22] Filed: Oct. 7, 1994

[51] Int. Cl.[6] ..... A24D 3/04; A24D 3/00

[52] U.S. Cl. ..... 131/338; 131/339; 131/340; 131/344; 131/336

[58] Field of Search ..... 131/365, 331, 131/336, 340, 344, 339, 338

[56] References Cited

U.S. PATENT DOCUMENTS

| | | | |
|---|---|---|---|
| 2,881,770 | 4/1959 | Touey . | |
| 2,988,085 | 6/1961 | Schur | 131/368 |
| 3,101,723 | 8/1963 | Seligman et al. . | |
| 3,353,543 | 11/1967 | Sproull et al. . | |
| 3,894,545 | 7/1975 | Crellin et al. . | |
| 4,331,166 | 5/1982 | Hab | 131/331 |
| 4,357,950 | 11/1982 | Berger | 131/340 |
| 4,481,958 | 11/1984 | Rainer et al. . | |

FOREIGN PATENT DOCUMENTS

| | | |
|---|---|---|
| A 532329 | 3/1993 | European Pat. Off. . |
| A 579410 | 1/1994 | European Pat. Off. . |
| A 608047 | 7/1994 | European Pat. Off. . |

*Primary Examiner*—Vincent Millin

[57] ABSTRACT

A cigarette having an improved carbon-bearing filter. A cigarette is provided with a smokable rod attached to a filter element having a region of carbon-bearing cellulose acetate tow surrounding a substantially impermeable member in the form of a hollow plastic tube crimped at the upstream end. As a result, the carbon-bearing region transitions from a circular cross-section to an annular cross-section. A plurality of circumferentially arranged holes are provided in the filter to permit dilution of the smoke passing through the filter. The resulting filter element provides reduction in gas phase components of smoke, dilution by ambient air and acceptable drawing characteristics.

7 Claims, 1 Drawing Sheet

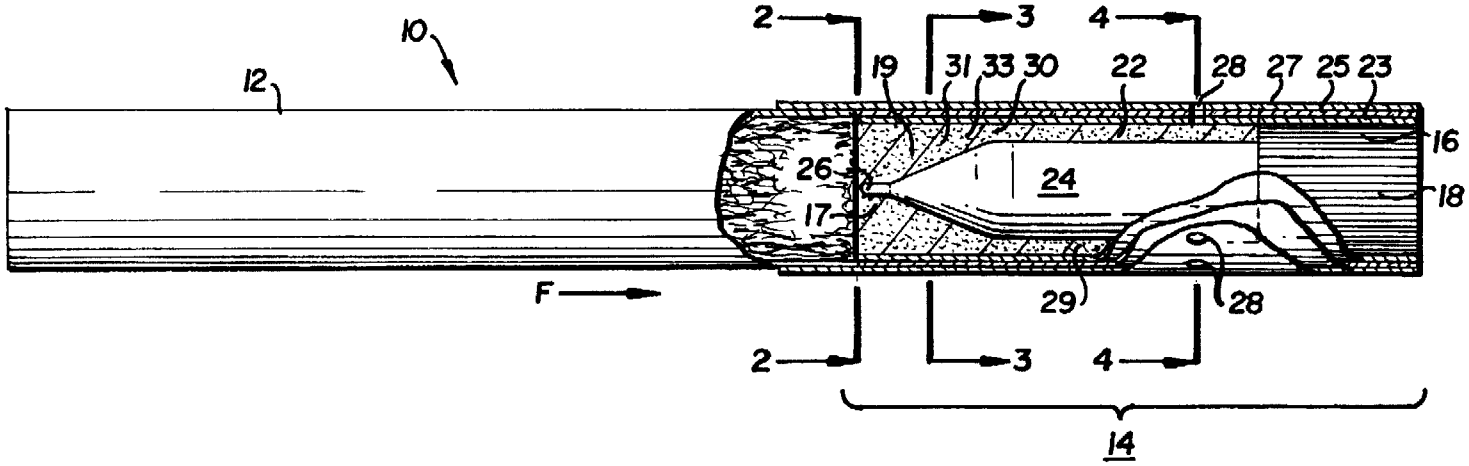
FIG. 1
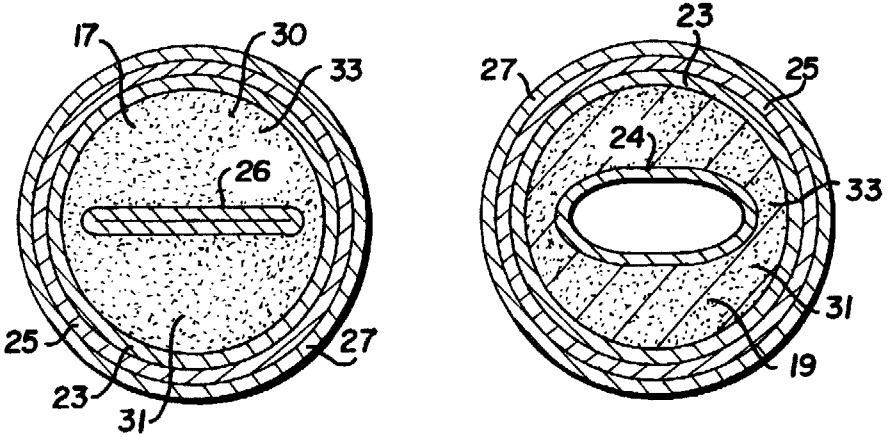
FIG. 2
FIG. 3
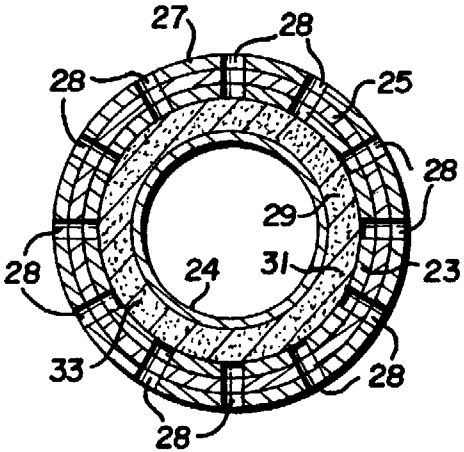
FIG. 4

LOW GAS PHASE FILTER FOR CIGARETTES

FIELD OF THE INVENTION

The present invention relates to smoking articles such as cigarettes, and in particular, to cigarettes having filter elements containing a carbonaceous material, and configured for advantageous removal of gas phase components from the smoke while achieving acceptable dilution and puff draw characteristics.

BACKGROUND OF THE INVENTION

Popular smoking articles, such as cigarettes, have a substantially cylindrical rod shaped structure and include a charge of smokable material such as shredded tobacco (e.g., in cut filler form) surrounded by a paper wrapper, thereby forming a so-called "tobacco rod." Normally, a cigarette has a cylindrical filter element aligned in an end-to-end relationship with the tobacco rod. Typically, the filter element includes cellulose acetate tow circumscribed by plug wrap, and is attached to the tobacco rod using a circumscribing tipping material. It also has become desirable to perforate the tipping material and plug wrap, in order to provide dilution of drawn mainstream smoke with ambient air.

Cigarettes are employed by the smoker by lighting one end thereof and burning the tobacco rod. The smoker then receives mainstream smoke into his/her mouth by drawing on the opposite end (e.g., the filter end) of the cigarette.

Certain cigarettes have filter elements which incorporate materials such as carbon. Exemplary cigarettes and filters are described in U.S. Pat. Nos. 2,881,770 to Tovey; 3,353,543 to Sproull et al.; 3,101,723 to Seligman et al.; and 4,481,958 to Ranier et al. and European Patent Application Nos. 532,329 and 608,047. Certain commercially available filters have particles or granules of carbon (e.g., an activated carbon material or an activated charcoal material) dispersed within cellulose acetate tow; other commercially available filters have carbon threads dispersed therein; while still other commercially available filters have so-called "cavity filter" or "triple filter" designs. Exemplary commercially available filters are available as SCS IV Dual Solid Charcoal Filter from American Filtrona Corp.; Triple Solid Charcoal Filter from FIL International, Ltd.; Triple Cavity Filter from Baumgartner; and ACT from FIL International, Ltd. See also, Clarke et al., *World Tobacco*, p. 55 (November 1992). Detailed discussion of the properties and composition of cigarettes and filters is found in U.S. patent application Ser. No. 08/076,711, filed Jun. 11, 1993 and in U.S. patent application Ser. No. 08/264,217, filed Jun. 22, 1994, the disclosures of which are hereby incorporated by reference.

Various annular configurations of filters having carbon-bearing annular filter regions are disclosed in the prior art. For example, European Patent Application No. 579,410 shows a number of cigarette embodiments having an annular carbon-bearing region surrounding either porous filtration material or an empty tubular cavity formed by a vapor phase porous membrane. Similarly, U.S. Pat. No. 3,894,545 to Crellin et al. shows various configurations of annular carbon-bearing regions surrounding a vapor phase porous membrane or a rod of carbon-bearing material surrounded by a vapor phase porous membrane.

Cigarette filter elements which incorporate carbon have the ability to change the character of mainstream smoke which passes therethrough. For example, such filter elements have the propensity to reduce the levels of certain gas phase components present in the mainstream smoke, resulting in a change in the organoleptic properties of that smoke. However, such filter elements often incorporate relatively high levels of carbon (e.g., in particulate form), and/or are longitudinally segmented in format and configuration. As such, filter elements incorporating carbon require numerous and labor intensive processing steps; and cigarettes incorporating such filter elements often can be characterized as having slightly metallic drying and powdery flavor characteristics.

In addition, the prior art filters do not address the desirability of achieving optimum residence times for the smoke in the regions of the filter bearing the carbon while at the same time achieving favorable dilution of the smoke with ambient air and allowing an acceptable draw for the user.

It would be desirable to provide a cigarette having a cigarette filter element incorporating carbon or other material capable of absorbing and/or adsorbing gas phase components present in mainstream cigarette smoke, which filter element can be manufactured in an efficient and effective manner, using a minimum of materials and providing favorable absorption/adsorption, dilution and drawing characteristics.

Furthermore, it would be desirable to provide such a filter element with desirable residence time in the carbon-containing region while simultaneously achieving a pressure drop in the dilution region so as to provide acceptable drawing characteristics of puffs of smoke having reduced gas phase components.

SUMMARY OF THE INVENTION

A cigarette filter in accordance with the present invention is provided having an initially circular region of cellulose acetate tow containing carbon, preferably in the form of activated charcoal granules, which transitions to an annular carbon-bearing region. The filter is circumferentially perforated to permit dilution of the smoke passing through the annular region. The carbon in the transitional region reduces certain condensible and non-condensible gas phase components present in the mainstream smoke by absorption and/or adsorption. The annular region also reduces gas phase components, but primarily serves as a pressure drop region, which, when combined with the dilution caused by ambient air through perforations downstream of the transitional region, results in favorable drawing characteristics while reducing per puff non-condensible gas phase components.

A preferred filter embodiment of the filter according to the invention is formed of an impermeable hollow plastic tube crimped at the upstream end facing the smokable rod of the cigarette and surrounded by an annular region of cellulose acetate tow bearing activated charcoal granules. This results in a smoke flow path that decreases in cross-sectional area and shape from circular to annular toward the mouth end of the filter. A circumferential row of perforations is provided in the wall of the filter to permit dilution of the smoke by mixing of air with smoke after it has traversed a substantial portion of the length of the annular region bearing the activated charcoal. This structure results in an inexpensive yet effective filter system providing removal of certain gas phase constituents of the smoke and dilution of the smoke by ambient air, while providing acceptable drawing characteristics for the smoker.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 1 is a partially fragmented longitudinal section of a cigarette having a filter according to the present invention;

FIG. 2 is a sectional view taken along line 2—2 of FIG. 1;

FIG. 3 is a sectional view taken along line 3—3 of FIG. 1; and

FIG. 4 is a sectional view taken along line 4—4 of FIG. 1.

DETAILED DESCRIPTION OF THE INVENTION

Referring now to the drawings wherein like elements are assigned like reference numerals, FIG. 1 shows a cigarette 10, having a rod of smokable material 12 and a filter element generally designated by reference numeral 14. Filter element 14 is comprised of two segments, a first or mouth end segment 16 and a second or rod end segment 22. Mouth end segment 16 is preferably approximately 7 mm in length and is formed of a low efficiency cellulose acetate tow 18 having representative denier per filament (dpf) values of approximately 8/40,000, 10/35,000, and 12/50,000 available from Eastman Chemical Co., Kingsport, Tenn., overwrapped by plug wrap layer 20. Alternatively, mouth end segment 16 can be formed from other low efficiency filter material such as gathered polypropylene. The second segment 22 or rod end of the filter element is interposed between smokable material rod 12 and mouth end segment 16, comprises an impermeable hollow plastic tube 24, closed by crimping at the upstream end 26 facing the smokable rod 12 and surrounded by a low efficiency (low permeability) cellulose acetate tow having activated charcoal granules embedded therein. Rod segment 22 is overwrapped by plug wrap 23 and is combined with mouth end segment 16 by a further plug wrap 25. A tipping paper layer 27 is used to attach filter element 14 to smokable rod 12. A row of circumferentially arranged air dilution holes or perforations 28 is provided around the periphery of the filter element 14, approximately 17 mm from the end of the mouthpiece 16. As a result of the presence of the crimped hollow tube 24, in flow direction F, a transition region 19 is provided from an essentially circular cross-sectional region 17 of carbon-bearing cellulose acetate tow having a low pressure drop to an essentially annular region 29 of carbon-bearing cellulose acetate tow having a high pressure drop. This transition region 19 in combination with the downstream location of the perforations 28 results in high retention or residence times for the smoke upstream of the perforations. As a result, as explained below, favorable reduction in gas phase components is achieved per puff, along with favorable dilution by ambient air and acceptable drawing characteristics.

The remaining figures illustrate further details of the filter element 14. FIG. 2 shows the crimped upstream end 26 of hollow plastic tube 24 in greater detail. The crimped end can be formed, for example, by heat sealing of an open end of a hollow circular tube or, alternatively, by use of an adhesive or a mechanical fold or crimp. FIG. 3 illustrates a cross-section of hollow plastic tube 24 along the transition of the tube from the crimped end to the annular cross-section. Thus, in profile, along the line of edge of the crimp, the tube is wedge-shaped. FIG. 4 shows the annular arrangement of carbon-bearing cellulose acetate tow and circumferentially arranged perforations 28.

As shown in FIG. 1, the space 30 surrounding tube 24 is filled with low efficiency tow 31 and activated charcoal granules 33. In use, the flow of smoke through this low efficiency tow creates a high pressure drop across the filtering column without significant filtration. The effect of the transition 19 from the circular cross-section 17 to annular cross-section 29 and the downstream location of the air dilution perforations 28 is to increase the pressure drop and to increase the retention time of the smoke in contact with the carbon in the transition region 19. The smoke is diluted by air passing through perforations 28 and mixing with the smoke to achieve air dilution in the approximate range of 50–52%. This embodiment of the filter positions the maximum amount of granular carbon 33 upstream of the air dilution perforations or holes 28, although other arrangements are contemplated.

EXAMPLE

An exemplary filter was assembled by removing about 30 mg of tow and 25 mg of carbon granules from the center of a 20 mm carbon-in-tow filter AN15501 available from Baumgartner, Inc., Mebane, N.C. A plastic tube with one end crimped was inserted into the cavity created by removing the tow. Cigarettes were fabricated with Camel Light 85 tobacco rod and the above filter. A 7 mm cellulose acetate (10/35,000 dpf) filter was made for the mouth end segment of the cigarette. Cigarettes were perforated at 17 mm from the mouth end to achieve a 52% dilution. Test results from these cigarettes are shown in the table below, comparing the example filter cigarettes with a control in the form of an unmodified Camel Light 85 having a non-carbon bearing cellulose acetate tow filter.

Parameters and Gas Phase Components For Cigarettes Testing According to FTC Delivery Requirements

| Test Parameter | Control Cigarette | Example Cigarette |
|---|---|---|
| Pressure drop, mm water | 112 | 105 |
| Air Dilution (%) | 18 | 52 |
| No. Puffs | 8.2 | 9 |
| WTPM, mg | 12.5 | 10.6 |
| CO, mg | 12 | 7.0* |
| Carbonyl Components | | |
| Formaldehyde, μg | 21 | 15 |
| Acetaldehyde, μg | 675 | 249 |
| Acetone, μg | 278 | 63 |
| Acrolein, μg | 81 | 15 |
| Total Carbonyl Compounds | 1055 | 342 |

*Based upon values established by prior testing at comparable air dilution levels.

It will be noted that considerable reductions were achieved in the FTC deliveries of condensible gas phase components, such as carbonyl compounds, as well as non-condensible gases, such as CO, by the cigarette having the example filter as compared with a cigarette having the control filter.

A crimped plastic tube has been used in the preferred embodiment as the member which is substantially impermeable to gas or vapor phase components for affecting a transition from a high retention time region to a high pressure drop region. It is contemplated that other shapes, such as conical or blunt end can be used. In addition, a solid member, such as one made of high density (and hence highly impermeable) cellulose acetate tow or a solid rod of low density material can also be used. Other impermeable membrane structures are also contemplated.

Although a certain presently preferred embodiment of the invention has been specifically illustrated and described herein, it will be appreciated by those skilled in the art to which the invention pertains that many modifications and variations of the present invention are possible in light of the above teachings without departing from the spirit and scope of the invention. Accordingly, it is intended that the invention be limited only to the extent required by the appended claims and the applicable rules of law.

What is claimed is:

1. A cigarette comprising:

a smokable rod; and a filter element positioned adjacent one end of said smokable rod, said filter element comprising first and second filter segments, said first filter segment including a substantially impermeable hollow plastic robe crimped at a first end facing said smokable rod and being open at a second end facing away from said smokable rod, said second filter segment comprising a low efficiency mouth end filter, said tube of the first filter segment being surrounded by a region of carbon-bearing filter material, said tube and said filter material defining an annular region having a high pressure drop and a high smoke retention time region between said annular region and said smokable rod, said high pressure drop region being provided with a plurality of air dilution holes for communicating with ambient air, said air dilution holes being located closely adjacent the open second end of the first filter segment such that smoke from the smokable rod passes through a substantial portion of the length of said annular high pressure drop region undiluted by ambient air from said dilution holes and is then diluted with ambient air just prior to passing into the second filter segment so as to increase the pressure drop and the retention time of the smoke in contact with the carbon of the carbon-bearing filter material.

2. The cigarette according to claim 1, wherein said air dilution holes are circumferentially located about 17 mm from the mouth end of the second filter segment.

3. The cigarette according to claim 1, wherein the air dilution is in the range of about 50–52%.

4. The cigarette according to claim 1, wherein the carbon-bearing filter material comprises cellulose acetate tow.

5. The cigarette according to claim 1, wherein the first and second filter segments comprise a low efficiency cellulose acetate tow.

6. The cigarette according to claim 5, wherein the cellulose acetate tow has a density selected from the group of densities consisting of 8/40,000, 10/35,000 and 12/50,000 denier per filament.

7. The cigarette according to claim 1, wherein the carbon-bearing filter material comprises activated charcoal embedded in cellulose acetate tow.

* * * * *